US006715860B2

(12) United States Patent
Watanabe

(10) Patent No.: US 6,715,860 B2
(45) Date of Patent: Apr. 6, 2004

(54) INK-JET HEAD AND THE PREPARATION METHOD THEREOF, AND A COATING LAYER AND THE PREPARATION METHOD THEREOF

(75) Inventor: Hideo Watanabe, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/126,102

(22) Filed: Apr. 18, 2002

(65) Prior Publication Data

US 2003/0052949 A1 Mar. 20, 2003

(30) Foreign Application Priority Data

Apr. 27, 2001 (JP) ..... 2001-130662

(51) Int. Cl.[7] ..... B41J 2/045
(52) U.S. Cl. ..... 347/68

(58) Field of Search ..... 347/68–72; 427/255.6; 428/32.1

(56) References Cited

FOREIGN PATENT DOCUMENTS

| | | | | |
|---|---|---|---|---|
| EP | 0863008 A2 * | 1/1998 | ..... | 347/68 |
| JP | 408052872 A * | 2/1996 | ..... | 347/68 |

* cited by examiner

*Primary Examiner*—Russell Adams
*Assistant Examiner*—An H. Do
(74) *Attorney, Agent, or Firm*—Frishauf, Holtz, Goodman & Chick, P.C.

(57) ABSTRACT

An ink-jet head with a substrate forming an ink channel having an electrode provided on an inner surface of the ink channel. A coating layer covers the electrode and is formed of poly-p-xylylene admixed with a silane coupling agent or a derivative of poly-p-xylylene admixed with a silane coupling agent.

17 Claims, 5 Drawing Sheets

INK-JET HEAD AND THE PREPARATION METHOD THEREOF, AND A COATING LAYER AND THE PREPARATION METHOD THEREOF

FIELD OF THE INVENTION

The present invention relates to an ink-jet head and the preparation method thereof, and further to a coating layer and the preparation method thereof. In particular, the present invention relates to an ink-jet head covered with a coating layer comprising poly-p-xylylene or a derivative of poly-p-xylylene to protect an electrode provided on an ink channel of the ink-jet head or an adhesive employed to make the ink-jet head, and the preparation method of the coating layer. The present invention also relates to a coating layer comprising poly-p-xylylene or a derivative of poly-p-xylylene, and the formation thereof. Hereafter, a coating layer comprising poly-p-xylylene or a derivative of poly-p-xylylene called as a parylene layer.

BACKGROUND OF THE INVENTION

In some of electronic parts (or components) such as various semiconductor elements and devices such as ink-jet heads, which employ various materials such as metals, ceramics, and plastics, as a substrate body or substrate materials having said various materials on the surface, a protective layer, which comprises organic materials, is frequently provided on said substrate body for the purpose of enhancing electrical insulation, moisture resistance, and abrasion resistance Further, in order to minimize elution of components of adhesives from joined parts which are adhered employing said adhesives, a protective layer, which comprises organic materials, is occasionally formed in the same manner. Of such protective layers, a parylene layer, which is formed employing a gas phase synthetic method, is preferably employed, since it exhibits high insulating properties as well as high moisture resistance. However, due to the fact that said parylene layer exhibits low adhesion to a substrate body, Japanese Patent Publication No. 58-56371 describes enhancement of adhesion to a substrate body by forming a parylene layer after said substrate body is subjected to a pre-treatment employing a coupling agent.

SUMMARY OF THE INVENTION

The method described in Japanese Examined Patent Publication No. Tokkosho 58-56371 assures improved adhesion of said parylene layer to a substrate body, compared to conventional methods. However, the resultant adhesion is found to be insufficient. As a result, problems have occasionally occurred in which said layer is peeled off during the production process. In addition, problems with durability of products have occurred in which products result in layer peeling under product-using circumstances. Specifically, said problems are pronounced when a substrate body comprises an electrode comprised of metal. Further, said problems become serious in ink-jet heads in which a PZT substrate is employed as a piezoelectric substrate, and said electrode is provided on said PZT substrate. As a result, the resultant product yield has been adversely affected by said peeling. In such ink-jet heads, it is assumed that the formation of the parylene layer in the interior of the minute ink channels is one of factors of the low production yield.

From the viewpoint of the foregoing, the present invention was achieved. An object of the present invention is to provide a parylene layer which exhibits excellent adhesion to a substrate body as well as excellent durability, a parylene layer forming method capable of preparing such a parylene layer, and an ink-jet head prepared employing said parylene layer or a parylene layer which is formed employing said parylene layer forming method.

Another object of the present invention is to provide a parylene layer which exhibits excellent insulating properties as well as excellent heat resistance, a parylene forming method capable of preparing such a parylene layer, and an ink-jet head prepared employing said parylene layer or a parylene layer which is formed employing said parylene layer forming method.

Still another object of the present invention is to provide a parylene layer which results in an increase in yield without forming pinholes even though said layer is relatively thin, a parylene forming method capable of preparing such a parylene layer, and an ink-jet head prepared employing said parylene layer or a parylene layer which is formed employing said parylene layer forming method.

A further object of the present invention is to provide a parylene layer which can be prepared easily and at low cost, a parylene forming method capable of preparing such a parylene layer, and an ink-jet head prepared employing said parylene layer or a parylene layer which is formed employing said parylene layer forming method.

In order to achieve at least one of the aforesaid objects, the present invention was constituted as described below.

(1) An ink-jet head comprising:
  (a) a substrate forming an ink channel having an electrode provided on an inner surface of the ink channel; and
  (b) a coating layer covering the electrode, wherein the coating layer comprises poly-p-xylylene or a derivative of poly-p-xylylene admixed with a silane coupling agent.

(2) A process for forming an ink-jet head, comprising the steps of:
  (a) providing an electrode on a surface of a substrate which forms an ink channel;
  (b) placing the substrate provided with the electrode in a deposition chamber; and
  (c) contacting the substrate with a vaporous poly-p-xylylene precursor or a vaporous poly-p-xylylene derivative precursor admixed with a vaporous silane coupling agent to form a coating layer onto the surface of the substrate.

(3) A process for forming an ink-jet head, comprising the steps of:
  (a) providing an electrode on a surface of a substrate which forms an ink channel;
  (b) placing the substrate provided with the electrode in a deposition chamber; and
  (c) contacting the substrate with a vaporous poly-p-xylylene precursor or a vaporous poly-p-xylylene derivative precursor admixed with a vaporous silane coupling agent to form a coating layer onto the surface of the substrate, wherein at least a part of the silane coupling agent remains unvaporized in the deposition chamber during the step (c).

(4) An ink-jet head having an ink channel comprising a piezoelectric substrate provided with an electrode on an inner surface of the ink channel, wherein an ink droplet is jetted from the ink channel by deforming the piezoelectric substrate in accordance with an applied electric field, the ink-jet head comprising covering the electrode, wherein the coating layer comprises poly-p-xylylene or a derivative of poly-p-xylylene admixed with a silane coupling agent.

(5) A process for forming an ink-jet head jetting an ink droplet from the ink channel by deforming a piezoelectric substrate in accordance with an applied electric field, comprising the steps of:

(a) providing an electrode on a surface of the piezoelectric substrate which forms an ink channel;

(b) placing the piezoelectric substrate provided with the electrode in a deposition chamber; and (c) contacting the piezoelectric substrate with a vaporous poly-p-xylylene precursor or a vaporous poly-p-xylylene derivative precursor in the presence of a vaporous silane coupling agent to form a coating layer onto the surface of the piezoelectric substrate.

(6) A process for forming an ink-jet head jetting an ink droplet from the ink channel by deforming a piezoelectric substrate in accordance with an applied electric field, comprising the steps of:

(a) providing an electrode on a surface of the piezoelectric substrate which forms an ink channel;

(b) placing the piezoelectric substrate provided with the electrode in a deposition chamber; and (c) contacting the piezoelectric substrate with a vaporous poly-p-xylylene precursor or a vaporous poly-p-xylylene derivative precursor admixed with a vaporous silane coupling agent to form a coating layer onto the surface of the substrate, wherein at least a part of the silane coupling agent remains unvaporized in the deposition chamber during the step (c).

(7) An article comprising:

(a) a substrate; and (b) a coating layer on the substrate, wherein the coating layer comprises poly-p-xylylene or a derivative of poly-p-xylylene admixed with a silane coupling agent.

(8) A process for forming a coating layer comprising poly-p-xylylene or a derivative of poly-p-xylylene on a substrate, comprising the steps of:

(a) placing the substrate in a deposition chamber; and (b) contacting the substrate with a vaporous poly-p-xylylene precursor or a vaporous poly-p-xylylene derivative precursor admixed with a vaporous silane coupling agent to form a coating layer onto the surface of the substrate.

(9) A process for forming a coating layer comprising poly-p-xylylene or a derivative of poly-p-xylylene on a substrate, comprising the steps of:

(a) placing the substrate in a deposition chamber; and (b) contacting the substrate with a vaporous poly-p-xylylene precursor or a vaporous poly-p-xylylene derivative precursor admixed with a vaporous silane coupling agent to form a coating layer onto the surface of the substrate, wherein at least a part of the silane coupling agent remains unvaporized in the deposition chamber during the step (b).

The invention, described in the above-mentioned item is characterized in that a parylene layer is formed on the surface of a substrate body and said parylene layer comprises a dispersed silane coupling agent. By such practice, it is possible to prepare a parylene layer which exhibits excellent adhesion to the substrate body as well as high durability, while utilizing layer performance as a parylene layer.

The invention described in the above-mentioned item is the parylene layer, described in the above-mentioned item, characterized in that said silane coupling agent is dispersed and incorporated so that some of said agent comes into contact with said substrate body. Due to that, adhesion to said substrate body, as well as durability, is enhanced. As a result, it is possible to minimize peeling of said parylene layer from said substrate body at the interface between the substrate and the parylene layer.

The invention, described in the above-mentioned item is the parylene layer described in the above-mentioned item, characterized in that the Si concentration of said coupling agent, which is incorporated into said parylene layer, within 0.1 $\mu$m from the interface with said substrate body is at least 0.1 mg/cm$^3$. By such practice, it is possible to further enhance the adhesion of said parylene layer to said substrate body.

The invention, described in the above-mentioned item, is the parylene layer, characterized in that the Si concentration of said coupling agent, which is incorporated into said parylene layer, within 0.1 $\mu$m from the interface with said substrate body is 5 mg/cm$^3$ or less. By such practice, said silane coupling agent is dispersed and incorporated into said parylene layer within 0.1 $\mu$m from the interface with said substrate body, which affects the adhesion to said substrate body. As a result, said silane coupling agent exists near the interface (the interface with said substrate body) of said parylene layer in a greater amount than required, whereby it is possible to prevent a decrease in adhesion between said parylene layer and said substrate body.

The invention, described in the above-mentioned item, is the parylene layer characterized in that the Si concentration of said silane coupling agent within 0.5 $\mu$m from the surface of said parylene layer is from 0 to 5 mg/cm$^3$. By such practice, the layer performance of the surface of said parylene layer is not adversely affected by the incorporation of said silane coupling agent. As a result, said parylene layer can exhibit the desired insulating properties as well as the desired moisture resistance.

The invention, described in the above-mentioned item is the parylene layer, described in any one of the above-mentioned items, characterized in that the content ratio of the component of parylene N in said parylene layer is 50 percent or less. By such practice, it is possible to prepare a parylene layer which is more heat resistant.

The structure of parylene N is shown below.

Parylene N: Poly-para-xylylene (or Poly-p-xylylene)

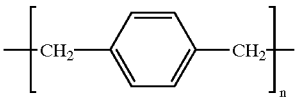

n > 5000

The invention, described in the above-mentioned item, is the parylene layer, described in any one of the above-mentioned items, characterized in that said parylene layer is comprised of a component of Parylene N, as well as a component of Parylene C, and when said parylene layer is divided into two layers consisting of a lower layer on the substrate body side and an upper layer on the opposite side of said substrate body, said lower layer comprises the component of said Parylene N in an amount of at least 70 percent, while said upper layer comprises the component of Parylene C in an amount of at least 70 percent. By such practice, it is possible to prepare a parylene layer which results in no pinholes, and exhibits excellent heat resistance as well as desired durability.

The structure of parylene C is shown below.

Parylene C: Poly-monochloro-para-xylylene, (or Poly-chloro-para-xylylene, or Poly-chloro-p-xylylene

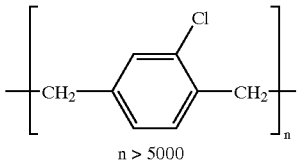

The invention, described in the above-mentioned item, is the parylene layer described in any one of the above-mentioned items, characterized in that the thickness of said parylene layer is from 1 to 10 μm. By such practice, while utilizing the layer performance of said parylene layer, it is possible at low cost to quickly and easily prepare a useful protective layer, which exhibits excellent adhesion to the substrate body.

The invention, described in the above-mentioned item, is the parylene layer forming method characterized in that in a parylene layer forming method in which said parylene layer is formed on the surface of a substrate body, said parylene layer is formed under an atmosphere of a silane coupling agent, employing a gas phase synthetic method. By such practice, while utilizing layer performance as a parylene layer, it is possible to easily prepare at low cost a parylene layer which exhibits excellent adhesion to the substrate body as well as desired durability.

The silane coupling agent incorporated in the parylene layer of the present invention may react with other substance or remains unreacted.

The invention, described in the above-mentioned item, is the parylene layer forming method characterized in that in a parylene layer forming method in which said parylene layer is formed on the surface of a substrate body, said parylene layer is formed employing a gas phase synthetic method under a state in which a supplied silane coupling agent is partly vaporized. By such practice, while utilizing layer performance as a parylene layer, it is possible to easily prepare at low cost a parylene layer which exhibits excellent adhesion to the substrate body as well as desired durability.

The invention, described in the above-mentioned item, is the parylene layer forming method, described in the above-mentioned item, characterized in that during formation of said parylene layer prepared by employing said gas phase synthetic method, said silane coupling agent is completely vaporized. By such practice, while the performance of the parylene layer surface is not adversely affected by said silane coupling agent, it is possible to prepare a parylene layer which exhibits desired insulating properties as well as desired moisture resistance.

The invention, described in the above-mentioned item, is the parylene layer forming method, described in the above-mentioned item, characterized in that said silane coupling agent is completely vaporized until a parylene layer of 5 μm is formed. By such practice, varying performance of the parylene layer surface is not adversely affected by said silane coupling agent. As a result, it is possible to prepare a parylene layer which exhibits desired insulating properties as well as desired moisture resistance.

The invention, described in the above-mentioned item, is the parylene layer forming method, described in any one of the above-mentioned items, characterized in that when said 0.1 μm thick parylene layer is formed, a part of said silane coupling agent remains under a state of not being vaporized. By such practice, it is possible to realize a condition in which parylene and a silane coupling coexist without fail and the silane coupling agent can be incorporated in the parylene layer. It is possible to prepare a parylene layer which exhibits enhanced adhesion to the substrate body.

The invention, described in the above-mentioned item, is the parylene layer forming method, described in any one of the above-mentioned items, characterized in that said parylene layer is prepared employing said gas phase synthetic method in which Parylene N is initially supplied, and thereafter, Parylene C is supplied. Following such practice, it is possible to prepare a parylene layer which results in no pinholes and exhibit excellent heat resistance as well as desired durability.

The invention, described in the above-mentioned item, is the parylene layer forming method, described in the above-mentioned item, characterized in that during formation of a parylene layer employing said Parylene C, said silane coupling agent is completely vaporized. By so practice, it is possible to prepare a parylene layer which results in no pinholes and exhibit enhanced heat resistance as well as desired durability.

The invention, described in the above-mentioned item, is the ink-jet head characterized in that in an ink-jet head in which an electrode is provided in an ink channel, said electrode is covered with the parylene layer described in any one of the above-mentioned items, or the parylene layer which has been formed employing the parylene forming method described in any one of the above-mentioned items. Following such practice, while utilizing performance as the parylene layer, it is possible at low cost to easily prepare a useful ink-jet head which exhibits excellent adhesion to the substrate body comprising an electrode, and is provided with a highly durable parylene layer.

The invention, described in the above-mentioned item, is the ink-jet head described in the above-mentioned item, characterized in that in an ink-jet head comprising an ink channel provided with an electrode on a piezoelectric substrate, and which ejects ink from said channel by applying voltage to said electrode so that said piezoelectric substrate is deformed, said electrode is covered with the parylene layer described in any one of the above-mentioned items, or the parylene layer which has been formed employing the parylene forming method described in any one of the above-mentioned items. Following such practice, while utilizing said performance as the parylene layer, it is possible at low cost to easily prepare a useful ink-jet head which exhibits excellent adhesion to the substrate body comprising an electrode, is provided with a highly durable parylene layer, and exhibits excellent ink injecting performance.

The invention, described in the above-mentioned item, is the ink-jet head described in the above-mentioned item, characterized in that said piezoelectric substrate is a PZT substrate. Following such practice, it is possible to easily prepare an ink-jet head which is provided with a parylene layer covering the substrate body comprised of said PZT substrate in the minute ink channels and the electrode on said substrate and which exhibits excellent durability.

DETAILED DESCRIPTION OF THE INVENTION

The parylene layer, the parylene layer forming method, and the ink-jet head of the present invention will now be described with reference to drawings. However, the present invention is not limited to these embodiments.

Figure 1:
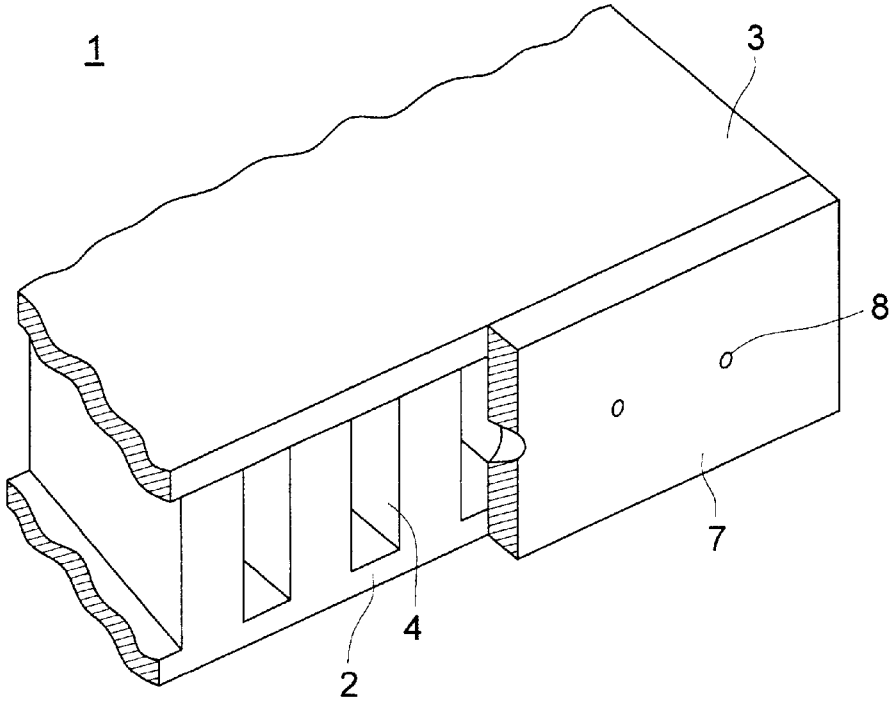
FIG. 1 is a schematic cross-sectional view of an ink-jet head of one embodiment of the present invention.
Figure 2:
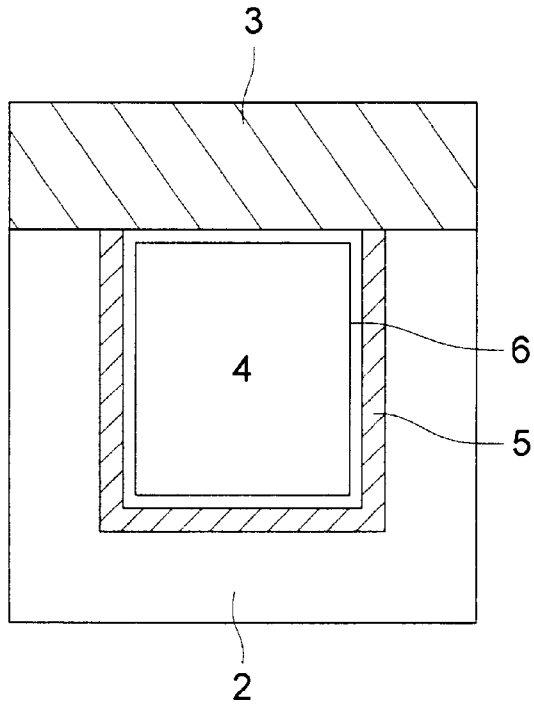
FIG. 2 is a schematic cross-sectional view of one ink channel in an ink-jet head.

FIG. 1 is a perspective view of an ink head which is one embodiment of the present invention. Further, FIG. 2 is a schematic cross-sectional view of one ink channel of said ink-jet head.

In ink head 1 of the present embodiment, ink channel 4, as an ink flow path, is formed employing piezoelectric substrate 2 and other wall forming member 3 (being an ink channel lid which is prepared by adhering a plate composed of glass, ceramic, metal, or plastic). On the interior wall of piezoelectric substrate 2, electrode 5 is provided, and the surface of said electrode 5 and other wall forming member 3 is covered with protective layer 6. Incidentally, in FIG. 1, numeral 7 is a nozzle plate and numeral 8 is a nozzle hole which is employed as an ink injecting hole formed in said nozzle plate 7.

Employed as piezoelectric substrates may be, for example, those of PZT, $BaTiO_3$, and $PbTiO_3$. Of these, said PZT substrate, which is a piezoelectric ceramic substrate comprising lead zirconate titanate ($Pb(Zr, Ti)O_3$), exhibiting desired piezoelectric characteristics, is preferred due to excellent piezoelectric characteristics such as a piezoelectric constant as well as high frequency responsivity.

Employed as member 3, which is used as a ceiling plate, may be various materials described above, as long as they exhibit high mechanical strength as well as ink resistance. However, said ceramic plate is preferably employed. Further, when use, in which said member 3 is adhered to a deformed piezoelectric ceramic plate such as said PZT plate, is considered, a non-piezoelectric ceramic plate is preferably employed, since it can maintain a fixed displacement of the side wall of a piezoelectric ceramic, can efficiently be driven due to its minimal deformation, and can decrease voltage.

Specifically listed may be, for example, substrates comprising, as at least one component, silicon, aluminum oxide (alumina), magnesium oxide, zirconium oxide, aluminum nitride, silicon nitride, silicon carbide, or quartz. Of these, ceramic plates comprising aluminum oxide or zirconium oxide, as a major component, are particularly preferred, since they exhibit excellent substrate characteristics even though thin, and destruction of said substrate due to warping and stress caused by expansion of said substrate due to heat generation during operation, as well as the variation of ambient temperature, can be decreased. Substrates comprising aluminum oxide as a major component are particularly preferred since they are less expensive and exhibit high insulating properties.

Further, it is preferable that said PZT substrate be employed as a side wall or a side wall as well as a bottom, and said non-piezoelectric ceramic substrate is employed as a bottom and/or a ceiling plate, since it is possible at low cost to produce a high performance sharing mode piezo type ink-jet head. Further, it is more preferable that said aluminum oxide substrate is employed as said non-piezoelectric ceramic substrate, since the resultant ink-jet head can be produced at lower cost.

Preferably formed as Electrode 5 is a metallic electrode layer (commonly from about 0.5 to abut 5.0 $\mu$m) comprised of gold, silver, aluminum, palladium, nickel, tantalum or titanium, employing vacuum evaporation, sputtering, and plating. Specifically, from the viewpoint of erosion resistance as well as machinability, a metallic electrode layer comprised of aluminum, tantalum, or titanium is particularly preferred.

Further, in order to enhance erosion resistance as well as stability of electrode 5, it is effective to carry out an anodic oxidation treatment. The specific example of said anodic oxidation treatment will now be detailed.

Employed as an electrolyte can be a pH 7.0±0.5 composition (adjusted by aqueous ammonia) comprised of 300 ml of ethylene glycol and 30 ml of 3 percent tartaric acid. A piezoelectric substrate, on which a 2.0 $\mu$m thick aluminum electrode layer has been formed, is immersed into said electrolyte. Subsequently, said anodic oxidation treatment is carried out in such a manner that a constant current is applied at a current density of 1 $mA/cm^2$ until said electrode reaches 100 V while said electrode layer is used as an positive electrode; after said voltage reaches 100 V, a constant voltage at 100 V is applied; and when said current density results in 0.1 $A/cm^2$ or less, said treatment is terminated.

Suitably employed as nozzle plate 7 are, for example, plastics such as polyalkylene, ethylene terephthalate, polyimide, polyether imide, polyether ketone, polyether sulfone, polycarbonate, and cellulose acetate.

Figure 3:
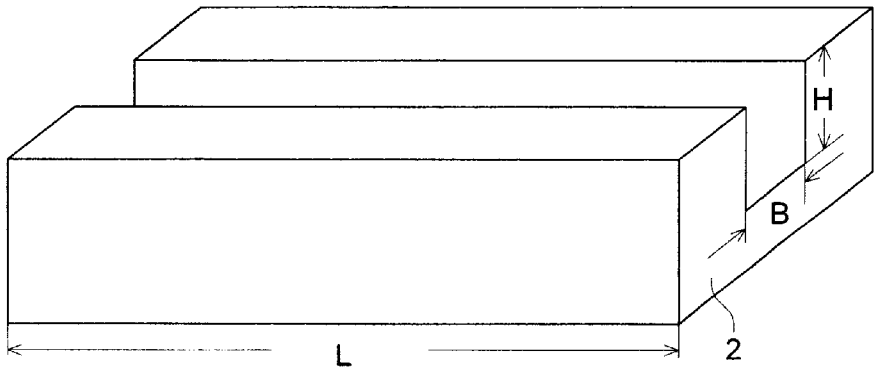
FIG. 3 is a view showing one section of piezoelectric substrate in one ink channel in FIG. 2.

FIG. 3 shows one part of piezoelectric substrate 2 in one of said ink channels. On one surface of 1 mm thick piezoelectric substrate 2, minute grooves (L: 30 mm, H: 360, and B: 70 $\mu$m) are machined. The machined surface of said piezoelectric substrate 2 is adhered with lid member 3 so that ink channel 4 (L: 30 mm, H: 360 $\mu$m, and B: 70 $\mu$m), which becomes an ink flow path, is constituted in the groove section. As shown in FIG. 1, one end of ink channel 4 is connected to an ink supply section (being an ink manifold), while the other end is connected to an ink ejection section constituted by nozzle plate 7 provided with nozzle holes 8. Incidentally, said ink supply section is preferably connected to said ink ejection section, following the protective layer forming process, described below, since ink-jet heads are easily produced.

After either formation of electrode 5 or the anodic oxidation process of electrode 5, and prior to the protective layer forming process, member 3, which forms another wall, is adhered to piezoelectric substrate 2. During said adhesion process, prior to coating of an adhesive, the machined surface, on which the groove section of piezoelectric substrate 2 has been machined, as well as the adhering surface of lid member 3, which covers said groove section, is preferably subjected to a pretreatment such as washing and polishing, depending upon its state. Excellent adhesion can be achieved by carrying out said pretreatment of the adhering surface.

The adhering surface of piezoelectric substrate 2 is adhered to the adhering surface of lid member 3 employing, for example, an epoxy adhesive so that said piezoelectric substrate 2 and said lid member 3 are bonded. After said bonding, for example, the resulting adhered interface is heated under pressure to approximately 120° C. and maintained for approximately 2 hours under said pressure and heated state so that said adhesive is cured. By carrying out said adhesion process, a 1.0 to 2.0 $\mu$m thick adhesive layer is formed in the adhered interface, and ink channel 4, which becomes an ink flow path, is formed in the bonded piezoelectric substrate 2 and lid member 3.

After said adhesion, protective layer 6 is formed on said bonded piezoelectric substrate 2 and lid member 3. In the present invention, employed as said protective layer 6 is a parylene layer.

Parylene is a generic term applied to the family of unsubstituted or substitute poly-p-xylylenes. Said parylene layer is a film comprised of poly-p-xylylene resins and/or derivatives thereof, which is formed employing a chemical vapor deposition method (a CVD method) in which a solid diparaxylylene dimer or derivatives thereof are employed as a deposition source. Namely, radical paraxylylene monomers, which are formed by vaporizing and thermally decomposing said paraxylylene dimer, are adsorbed onto the substrate and undergo polymerization reaction resulting in a layer.

Further, a layer formed employing diparaxylylene, which is a dimer of paraxylylene, is specifically called Parylene N, while a layer formed employing a dimer of the monochloro-substituted paraxylylene (one dimer has two chlorine atoms in its molecular structure), is called Parylene C. In addition, there are various parylene layers employing a diparaxylylene dimer having various substituents and derivatives thereof. Depending on required performance, various parylene layers or parylene layers, which are formed by laminating a plurality of various parylene layers, may be employed as the desired parylene layer.

Preferred as parylene layers are those which are prepared by initially supplying Parylene N and subsequently supplying Parylene C. These are preferred as parylene layers to specifically protect the electrode of an ink-jet head, since by such practice, it is possible to easily prepare a protective layer which results in no pinholes, and exhibit excellent heat resistance as well as desired durability.

Further, the content ratio of the component of Parylene N in said parylene layer is preferably 50 mole percent or less of the total parylene in the layer. Due to that, it is possible to prepare a parylene layer which exhibits greater heat resistance.

Still further, when said parylene layer is divided into a lower layer on the substrate body side and an upper layer on the opposite side of said substrate body, in the thickness direction, said lower layer preferably comprises the Parylene N component in an amount of at least 70 mole percent, while said upper layer preferably comprises the Parylene C component in an amount of at least 70 mole percent. Following such practice, it is possible to prepare a parylene layer which results in no pinholes and exhibits excellent heat resistance as well as desired durability.

The thickness of said parylene layer is preferably from 1 to 10 $\mu$m. By achieving said thickness, while utilizing performance of said parylene layer, it is possible at low cost to quickly and easily prepare a useful parylene which exhibits excellent adhesion to the substrate body. Specifically, by adjusting the thickness of said parylene layer to 1 to 10 $\mu$m, it is possible to prepare an ink-jet head which exhibits excellent ink injection performance.

In the present invention, said parylene layer is formed on a substrate body under an atmosphere of a silane coupling agent vapor, employing a gas phase synthetic method. By such practice, a parylene layer is prepared into which said silane coupling agent is dispersed and incorporated.

Cited as said silane coupling agents are, for example, vinyltriethoxysilane, vinyl-tris(β-methoxyethoxy)silane, γ-methacryloxypropyltrimethoxysilane, β-(3,4-epoxycyclohexyl)-ethyltrimethoxysilane, γ-glycidoxypropyltrimethoxysilane, vinyltriacetoxysilane, γ-mercaptopropyltrimethoxysilane, γ-aminopropyltriethoxysilane, and N-β-(aminoethyl)-, γ-aminopropyltrimethoxysilane. In addition to these, it is possible to employ various other organosilicon compounds.

Figure 4:
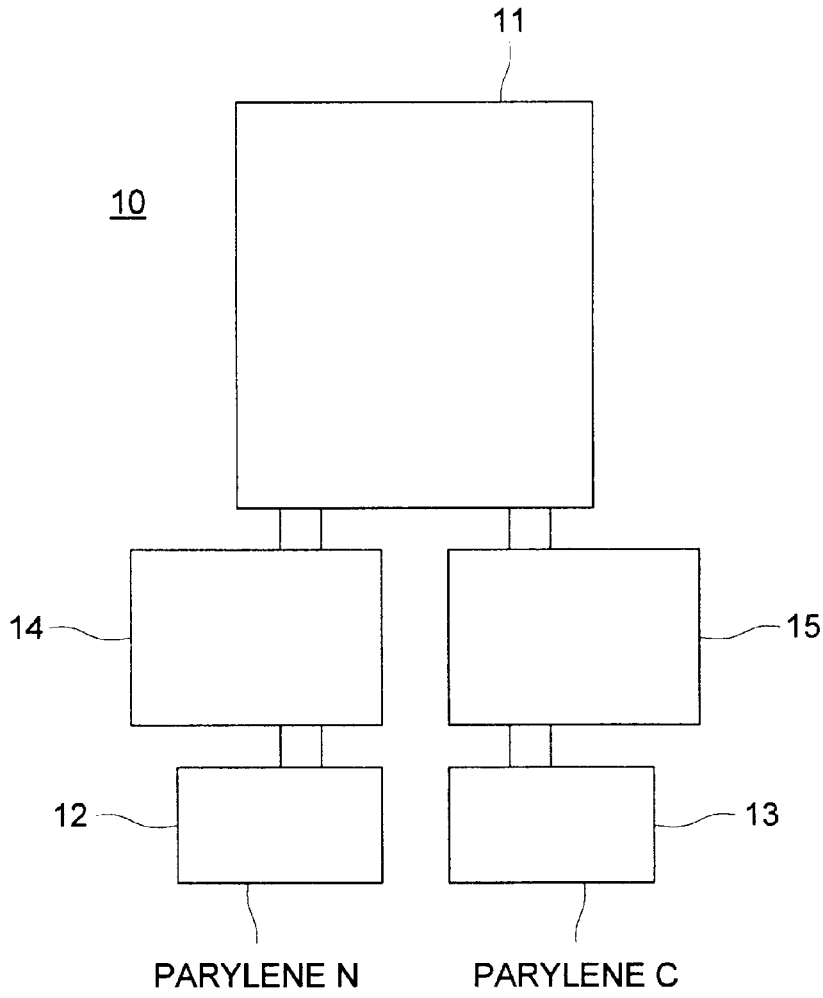
FIG. 4 is a schematic view showing one example of a layer forming apparatus.

FIG. 4 is a schematic view showing one example of a layer forming apparatus to form protective layer 6 which is a parylene layer into which the silane coupling agents described above are dispersed and incorporated.

Said layer forming apparatus 10 of the present embodiment is constituted in such a manner that layer forming chamber 11 is connected to two series of sublimation chambers 12 and 13, as well as thermal decomposition chambers 14 and 15. In one of the embodiments of the present invention, Parylene N was placed in chamber 12 and Parylene C was placed in chamber 13.

Said substrate body and said silane coupling agents are placed in the interior of said layer forming chamber 11, and the interior of said layer forming chamber 11 is exhausted by operating a vacuum pump (not shown) which is separately connected to said layer forming chamber 11 via a switch valve. Generally, silane coupling agents are easily vaporized at normal temperature (e.g. 20° C.). Accordingly, radical paraxylylene dimer in the vapor of said silane coupling agents is introduced into layer forming chamber 11 from either thermal decomposition chamber 14 or 15, whereby a parylene layer, into which said silane coupling agents have been dispersed and incorporated, is applied onto the substrate body.

The layer forming apparatus, shown in FIG. 4, is constituted so as to make it possible to prepare different types of parylene layers due to the arrangement of two sublimation chambers as well as two thermal decomposition chambers. Naturally, one type of a parylene layer may be formed employing said chambers in one series. Further, said layer forming apparatus may be constituted in such a manner that said vacuum pump is connected to layer forming chamber 11 via a switch valve so that said layer is formed while providing said silane coupling agents in the interior of layer forming chamber 11. However, the following embodiment may also be employed for forming said parylene layer. A vapor generating chamber is separately connected to said layer forming chamber via a switch valve (preferably being a needle valve). In said vapor generating chamber, a vapor of said silane coupling agents is generated, which is then introduced into layer forming chamber 11, and under the state in which the vapor of said silane coupling agents is present, a parylene layer is formed in the same manner. Incidentally, said layer forming apparatus is not limited to these and may be modified to other various types.

Preferred is the case in which a layer is formed so that silane coupling agents are placed in the interior of layer forming chamber 11, since as shown in FIG. 4, a common layer forming apparatus for parylene layers, which is prepared employing a gas phase method, can be employed without any modification. Further, a case is also preferred, in which a vapor generating chamber, which generates the vapor of said silane coupling agents, is separately provided; said vapor generating chamber is connected to layer forming chamber 11 via valve; and a layer is formed while suitably switching said a valve, since it is possible to adjust the dispersion of said silane coupling agents into the parylene layer to the desired state due to the fact that the vapor amount of the silane coupling agent introduced to layer forming chamber 11 can easily be controlled, and vapor introduction can easily be terminated.

As described above, by forming said parylene layer under an atmosphere of a vapor of said silane coupling agent, employing a gas phase method, said silane coupling agent can be dispersed and incorporated into said parylene layer. Following such practice, while utilizing the layer performance as a parylene layer, it is possible to prepare a parylene layer which exhibits excellent adhesion to the substrate body as well as high durability. Further, it is possible to shorten the production time as well as to lower the product cost due to the fact that the parylene layer, which exhibits improved adhesion, is simple to form, employing a gas phase method while using manufacturing facility which is almost similar to common parylene layer manufacturing facility; the resultant parylene layer exhibits high performance; and the production yield is enhanced.

Further, by initiating the formation of a parylene layer employing a gas phase method, it is possible to disperse at least a part of said silane coupling agent so it comes into contact with the surface of said substrate body. As a result, it is possible to enhance adhesion to said substrate body as well as to enhance durability, and to effectively minimize peeling of said parylene layer at the interface with said substrate body.

The Si concentration of said silane coupling agent incorporated within 0.1 $\mu$m from the interface with said substrate body is preferably at least 0.1 mg/cm$^3$. Following such practice, it is possible to further enhance adhesion of said parylene layer to said substrate body.

Further, by adjusting the Si concentration of said silane coupling agent incorporated within 0.1 $\mu$m from the interface with said substrate body to 5 mg/cm$^3$ or less, said silane coupling agent results in a dispersed and incorporated state within 0.1 $\mu$m of said parylene layer from the interface with said substrate body, which results in major desired effects in regard to adhesion to said substrate body. As a result, said silane coupling agent is present in a greater amount than required at the portions near the interface with said substrate body. As a result, for example, it is possible to minimize degradation of adhesion of said parylene layer to said substrate due to the fact that said silane coupling agent comes into contact with the entire surface of said substrate body.

Still further, it is preferable that the Si concentration of said silane coupling agent incorporated in a parylene layer within 0.5 $\mu$m from the surface of said parylene layer be adjusted to 0 to 0.5 mg/cm$^3$. By such practice, the layer performance of the surface of said parylene layer is not adversely affected by said silane coupling agent, so that insulating properties as well as moisture resistance of said parylene layer can be sufficiently exhibited.

Figure 5:
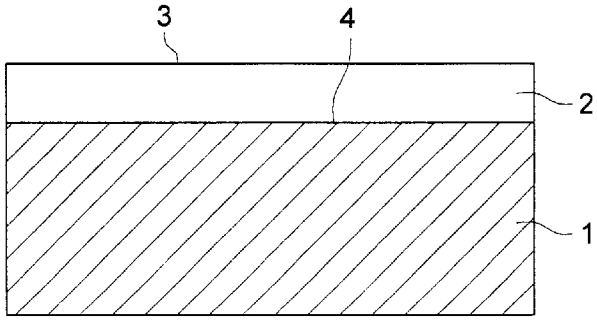
FIG. 5 represents a schematic view showing one example of a coating layer 2 on a substrate 1.

FIG. 5 represents a schematic view showing one example of a coating layer 2 on a substrate 1. The substrates can form an ink channel. Number 3 indicates the outermost surface of the coating layer and number 4 indicates the coating layer-substrate interface.

EXAMPLE 1

An ink-jet head was prepared employing the following processes.

(1) A 360 $\mu$m deep, 70 mm wide, and 30 mm long groove was formed in a 1 mm thick PZT substrate, of which upper surface was adhered with a dry film, at a pitch of 140 $\mu$m, employing a dieing saw.

(2) An aluminum layer was formed on the upper surface as well as the interior wall of the grooves employing aluminum vacuum evaporation.

(3) The aluminum layer vacuum-evaporated on the upper surface of said PZT substrate was removed by peeling off said dry film utilizing acetone, and an aluminum electrode was formed on the interior wall of said groove.

(4) An ink channel was formed by adhering an aluminum substrate used as a lid member so as to cover said groove, employing a 2-liquid type epoxy adhesive (Epo-Tec 353ND, manufactured by Epoxy Technology Co.). The resulting member was designated as a substrate body.

(5) Subsequently, said substrate body was arranged in the interior of a layer forming chamber, and a porous sponge impregnated with 5 ml of γ-methacryloxypropyltrimethoxysilane was placed on the bottom of said film forming chamber. The interior of said layer forming chamber was then exhausted employing a vacuum pump. In this case, a vapor pressure of 30 mTorr was maintained for about one hour after the beginning of exhaustion since vaporization of γ-methacryloxypropyltrimethoxysilane was limited. In the present example, 30 minutes after initiation of said exhaustion, layer forming was initiated under an atmosphere of γ-methacryloxypropyltrimethoxysilane while initially sublime-decomposing Parylene N. When a 1 $\mu$m thick layer was formed, sublimation-decomposition of Parylene C was initiated, and at the same time, sublimation of Parylene N was gradually terminated. Finally, layer forming was carried out employing only Parylene C, whereby a 7 $\mu$m thick parylene layer was formed. Incidentally, under an atmosphere of γ-methacryloxypropyltrimethoxysilane at the time when layer forming was initiated by sublime-decomposing Parylene N, γ-methacryloxypropyltrimethoxysilane was partially vaporized. Further, in the present example, all of 5 ml of γ-methacryloxypropyltrimethoxysilane was vaporized during formation of the Parylene C layer at a thickness of approximately 4 $\mu$m.

(6) A nozzle plate, comprised of polyimide, was adhered employing a 2-liquid type epoxy adhesive (Epo-Tec 353ND, manufactured by Epoxy Technology Co.) so as to cover the opening of one side of all the ink channels.

(7) The other open sections of all the ink channels were attached to an ink manifold via an ink supply plate having an ink supply hole, whereby an ink-jet head was prepared.

Incidentally, it is preferable that the part of said parylene layer, which is not provided with said protective layer be subjected to prior masking.

EXAMPLE 2

An ink-jet head was prepared in the same manner as Example 1, except that in said processes (1) through (7), process (5) was carried out as described below. In Example 2, a layer forming apparatus was employed in which a layer forming chamber was connected to a vapor generating chamber via a needle valve. In said vapor generating chamber, a vapor of γ-methacryloxypropyltrimethoxysilane was generated, which was introduced to said layer forming chamber by switching said valve.

In the present example, a substrate body was arranged in the interior of said layer forming chamber and a vapor of γ-methacryloxypropyltrimethoxysilane was introduced by opening said valve to the interior of said layer forming chamber for 30 minutes. After filling the interior of said layer forming chamber with said vapor, layer forming was initiated while firstly sublime-decomposing Parylene N. When the thickness of the formed layer reached 0.1 μm, the introduction of γ-methacryloxypropyltrimethoxysilane vapor was terminated by closing said valve. Thereafter, sublimation-decomposition of Parylene C was initiated and at the same time, sublimation of Parylene N was gradually terminated. Finally, said layer forming was carried out employing only Parylene C, whereby a 7 μm thick parylene layer was formed. As described above, process (5) was carried out.

OTHER EXAMPLES

Ink-jet heads were prepared in the same manner as Example 1 or 2, except that layer forming conditions (the supply amount of said silane coupling agent, the supply amount and introduction timing of Parylene N and Parylene C, and the pressure and temperature in the interior of said layer forming chamber) were variously altered. Naturally, parylene layer forming was initiated under an atmosphere of vapor of γ-methacryloxypropyltrimethoxysilane as a coupling agent so that γ-methacryloxypropyltrimethoxysilane was disperse-incorporated into said parylene layer. The results are shown in Table 1 below as those of Examples 3 through 7.

COMPARATIVE EXAMPLE

An ink-jet head was prepared in the same manner as Example 1, except that in processes (1) through (7), process (5) was altered as described below. In said Comparative Example, a substrate body was arranged in the interior of layer forming chamber 11 and a circular plate for weighing the metal charged with 5 ml of γ-methacryloxypropyltrimethoxysilane was placed on the bottom of said layer forming chamber 11, which was then exhausted to a pressure of $6\times10^{-6}$ Torr, employing a vacuum pump so that said substrate body was covered with γ-methacryloxypropyltrimethoxysilane. The layer formation of parylene C is carried out after all the silane coupling agent is evaporated and exhausted from the deposition chamber. Thereafter, sublimation-decomposition of Parylene C was initiated, whereby a 7 μm thick parylene layer comprised of Parylene C was formed.

The results of each Example as well as the Comparative Example are shown in Table 1. In Table 1, each evaluation item is as follows. Herein, Si concentration (being the silicon concentration) in said parylene layer was analyzed as described below. After burning each sample to ashes, the resultant ashes were subjected to alkali dissolution, employing sodium carbonate, and silicon was quantitatively analyzed at a measurement wavelength of 251.6 nm of ICP-AES measurement, employing SPS4000, manufactured by Seiko Denshi Co. On the other hand, the resultant parylene layer was cut so as to prepare an oblique cross-section. Si concentration distribution (in terms of a relative value) was obtained in such a manner that the resultant cross-section was subjected to Tof-SIMS measurement at an acceleration voltage of 15 kV, employing TRIFT II manufactured by Albackfy Co. Subsequently, Si concentration distribution (in terms of an absolute value) was obtained, while combining with the quantitatively analyzed Si data obtained employing said ICP-AES measurement. Further, the content of Parylene N as well as Parylene C was analyzed as described below. After burning each sample to ashes, the resultant ashes were subjected to alkali dissolution employing sodium carbonate and chlorine was quantitatively analyzed, employing ICP-AES measurement. Thus said content was analyzed substrated on the Parylene C ratio.

(Adhesion Force)

Ink-jet heads having a nozzle surface of 2 mm×40 mm were employed to measure the adhesion force. A polyimide tape having 2 mm of width, 50 mm of length and 50 μm of thickness was prepared. It was adhered on the nozzle surface with a two liquid type epoxy adhesive (Epo-Tec 353ND). A 10 mm part of the polyimide tape was outside the nozzle surface. The outside part was picked and peel tests were carried out.

The adhesion force of each parylene layer on said substrate body was evaluated by determining the peeling load necessary for separating said parylene layer from said substrate body in a perpendicular direction to the nozzle surface.

(Pinholes)

With regard to each ink-jet head of Examples and the Comparative Example prepared as described above, the presence or absence of pinhole formation was evaluated. The presence of only one pinhole results in a major factor to decrease a production yield due to the fact that in an ink-jet head, employing piezoelectric substrate which is operated by application of voltage, the electrode results in burnout and the resultant ink-jet head ceases to be functional.

Ink-jet heads having 256 ink channel (therefore having 256 electrodes) were employed for measurement. The ink channel portion of the ink-jet head was immersed in the ink. All of the electrodes were connected to one of the terminal of a pulse power supply (±40V; cycle: 10 kHz) and another terminal of the power supply was connected to the counter electrode. A pulse power was applied for 30 minutes. Then, a voltage of 40 V was applied to each of the electrodes. When a current of more than 10 nA was detected, it was considered that there was a pinhole. The number of electrodes which exhibit more than 10 nA was counted and determined pinhole numbers.

(Heat Resistance)

With regard to each ink-jet head of Examples and the Comparative Example prepared as described above, heat resistance was evaluated. Each of the ink-jet heads was heated at 120° C. for 2 hours. Thereafter, evaluation was carried out by counting the number of pinholes.

(Durability)

Twenty ink-jet heads of each of the Examples and the Comparative Example were prepared as described above. Employing each ink-jet head, water substrated ink was ejected at a driving voltage of 20 V. During repeated $1\times10^{10}$ shots, said durability was evaluated by counting the number of non-viable products which resulted in zero ink ejection.

Ink-jet head having 256 channel were employed for the test. When there is a pinhole, corrosion of an electrode takes place and ink-jetting cannot be achieved. Even one channel deficiency cannot be accepted.

TABLE 1

| | Si Concentration from Substrate Body Interface to 0.1 μm Thickness (in mg/cm³) | Si Concentration from Layer Surface to 0.1 μm Thickness (in mg/cm³) | Content of Parylene N (in mole %) | Content of Parylene N in the Lower Half of Layer (in mole %) | Content of Parylene C in the Upper Half of Layer (in mole %) | Adhesion (Adhesion Force) (in g) | Pin-hole | Heat Resis-tance | Dura-bility |
|---|---|---|---|---|---|---|---|---|---|
| Example 1 | 0.2 | 0 | 39 | 75 | 98 | 120 | none | 0 | 0 |
| Example 2 | 0.3 | 0 | 35 | 70 | 100 | 130 | none | 0 | 0 |
| Example 3 | 0.05 | 0 | 38 | 73 | 97 | 90 | none | 2 | 1 |
| Example 4 | 0.3 | 1 | 36 | 72 | 100 | 130 | none | 0 | 0 |
| Example 5 | 0.3 | 0 | 53 | 100 | 95 | 130 | none | 0 | 0 |
| Example 6 | 0.2 | 0 | 34 | 68 | 100 | 115 | none | 0 | 0 |
| Example 7 | 0.4 | 0 | 52 | 70 | 67 | 135 | none | 0 | 0 |
| Comparative Example | 0 | 0 | 35 | 70 | 100 | 50 | none | 10 | 5 |

(Effects of the Si concentration in the parylene layer: Test A)

A set of test samples were prepared to demonstrate the effect of the Si concentration in the depth direction of the layer.

Samples having various Si concentration within a 0.1 μm region from the coating layer-substrate interface were prepared by changing the amount of silane coupling agent.

All of these samples have common features:

(i) Parylene N concentration in the layer; 35 mole % based on the total parylenes in the coating layer (ii) Parylene N concentration within a region of a half of the coating layer thickness from the coating layer-substrate interface; 70 mole % based on the parylenes in the same region (iii) Parylene C concentration within a region of a half of the coating layer thickness from the outermost surface of the coating layer; 100 mole %.

The experimental results are shown in Table 2.

TABLE 2

| | Si Concentration (mg/cm³) | Adhesion (g) | Heat Resistance | Durability |
|---|---|---|---|---|
| Example 2-1 | 0 | 50 | 10 | 5 |
| Example 2-2 | 0.05 | 90 | 2 | 1 |
| Example 2-3 | 0.1 | 100 | 0 | 0 |
| Example 2-4 | 0.2 | 125 | 0 | 0 |
| Example 2-5 | 1 | 130 | 0 | 0 |
| Example 2-6 | 3 | 130 | 0 | 0 |
| Example 2-7 | 5 | 100 | 0 | 0 |
| Example 2-8 | 7 | 90 | 1 | 1 |
| Example 2-9 | 10 | 80 | 2 | 1 |

(Effects of the Si concentration in the parylene layer: Test B)

Another set of samples were prepared to demonstrate the effect of Si concentration in the depth direction of the layer.

Samples having various Si concentration (from 0 to 100 mole %) within a 0.5 μm region from the outermost surface of the coating layer were prepared by changing the amount of the silane coupling agent. All of these samples have common features:

(i) Parylene N concentration in the layer; 35 mole % based on the total parylenes in the coating layer (ii) Parylene N concentration within a region of a half of the coating layer thickness from the coating layer-substrate interface; 70 mole % based on the parylenes in the same region (iii) Parylene C concentration within a region of a half of the coating layer thickness from the outermost surface of the coating layer; 100 mole %

(iv) Si concentration within a 0.1 μm region from the coating layer-substrate interface; 0.2 mg/cm³

(v) The thickness of the coating layer; 5 μm

The experimental results are shown in Table 3

TABLE 3

| | Si Concentration (mg/cm³) | Adhesion (g) | Heat Resistance | Durability |
|---|---|---|---|---|
| Example 3-1 | 0 | 120 | 0 | 0 |
| Example 3-2 | 0.2 | 125 | 0 | 0 |
| Example 3-3 | 0.5 | 125 | 0 | 0 |
| Example 3-4 | 1 | 125 | 2 | 1 |
| Example 3-5 | 3 | 125 | 3 | 1 |

(The effect of parylene N concentration in the depth direction of the coating layer: Test C)

Samples having a parylene N layer and a parylene C layer in that order on the substrate were prepared. By changing the thickness of each two layers, samples having different parylene N concentration in the depth direction of the coating layer were obtained.

All of these samples have common features:

(i) Parylene N concentration in the under layer; 100 mole %

(ii) Parylene C concentration in the upper layer; 100 mole %

(iii) Si concentration within a 0.1 μm region from the coating layer-substrate interface; 0.2 mg/cm³

(iv) The thickness of the coating layer; 5 μm

The experimental results are shown in Table 4.

TABLE 4

| | N Concentration (%) | Adhesion (g) | Heat Resistance | Durability |
|---|---|---|---|---|
| Example 4-1 | 0 | 120 | 0 | 0 |
| Example 4-2 | 10 | 125 | 0 | 0 |
| Example 4-3 | 30 | 125 | 0 | 0 |
| Example 4-4 | 50 | 125 | 0 | 0 |
| Example 4-5 | 70 | 125 | 2 | 1 |
| Example 4-6 | 100 | 125 | 3 | 1 |

Further, in the foregoing, the embodiments of ink-jet heads have been described. However, it is possible to apply the present invention to the other products other than ink-jet heads, as well as other technical fields, and further to various embodiments in which said parylene layer is formed on a substrate body as a protective layer. Accordingly, employed as substrate bodies may be various ones. Further, it is possible to apply the present invention to various materials such as plastics, metals and ceramics.

The present invention makes it possible to provide a parylene layer which exhibits excellent adhesion to a substrate body as well as excellent durability, a parylene layer forming method capable of preparing said parylene layer, and to provide an ink-jet head prepared employing said parylene layer or a parylene layer which is prepared employing said parylene layer forming method.

What is claimed is:

1. An ink-jet head comprising:

(a) a substrate forming an ink channel having an electrode provided on an inner surface of the ink channel; and (b) a coating layer covering the electrode, wherein the coating layer contains poly-p-xylylene admixed with a silane coupling agent or a derivative of poly-p-xylylene admixed with a silane coupling agent.

2. The ink-jet head of claim 1, wherein the coating layer comprises poly-p-xylylene (parylene N) and poly-chloro-p-xylylene (parylene C).

3. The ink-jet head of claim 1, wherein the thickness of the coating layer is from 1 to 10 $\mu$m.

4. An ink-let head comprising:

(a) a substrate forming an ink channel having an electrode provided on an inner surface of the ink channel; and (b) a coating layer covering the electrode, wherein the coating layer comprises poly-p-xylylene admixed with a silane coupling agent or a derivative of poly-p-xylylene admixed with a silane coupling agent; and wherein the coating layer comprises the silane coupling agent in an amount of at least 0.1 mg/cm$^3$ expressed in terms of Si within a 0.1 $\mu$m region from the coating layer-substrate interface.

5. The ink-jet head of claim 4, wherein the coating layer comprises the silane coupling agent in an amount of at most 5 mg/cm$^3$ expressed in terms of Si within the 0.1 $\mu$m region from the coating layer-substrate interface.

6. A An ink-jet head comprising:

(a) a substrate forming an ink channel having an electrode provided on an inner surface of the ink channel; and (b) a coating layer covering the electrode, wherein the coating layer comprises poly-p-xylylene admixed with a silane coupling agent or a derivative of poly-p-xylylene admixed with a silane coupling agent; and wherein the coating layer comprises the silane coupling agent in an amount of from 0 to 0.5 mg/cm$^3$ expressed in terms of Si within a 0.5 $\mu$m region from the outermost surface of the coating layer.

7. An ink-jet head comprising:

(a) a substrate forming an ink channel having an electrode provided on an inner surface of the ink channel; and (b) a coating layer covering the electrode, wherein the coating layer comprises poly-p-xylylene admixed with a silane coupling agent or a derivative of poly-p-xylylene admixed with a silane coupling agent; and wherein the coating layer comprises poly-p-xylylene (parylene N) in an amount of at most 50 mole % based on the moles of compounds in the coating layer.

8. An ink-jet head comprising:

(a) a substrate forming an ink channel having an electrode provided on an inner surface of the ink channel; and (b) a coating layer covering the electrode, wherein the coating layer comprises poly-p-xylylene admixed with a silane coupling agent or a derivative of poly-p-xylylene admixed with a silane coupling agent; and wherein the coating layer comprises poly-p-xylylene (parylene N) and poly-chloro-p-xylylene (parylene C), said poly-p-xylylene (parylene N) is contained in an amount of at least 70 mole % based on the moles of compounds in the coating layer within a region of a half of the coating layer thickness from the coating layer-substrate interface; and said poly-chloro-p-xylylene (parylene C) is contained in an amount of at least 70 mole % based on the moles of compounds in the coating layer within a region of a half of the coating layer thickness from the outermost surface of the coating layer.

9. An ink-jet head having an ink channel comprising a piezoelectric substrate provided with an electrode on an inner surface of the ink channel, wherein an ink droplet is jetted from the ink channel by deforming the piezoelectric substrate in accordance with an applied electric field, the ink-jet head comprising a coating layer covering the electrode, wherein the coating layer comprises poly-p-xylylene or a derivative of poly-p-xylylene admixed with a silane coupling agent.

10. The ink-jet head of claim 9, wherein the piezoelectric substrate is a PZT substrate.

11. The ink-jet head of claim 9, wherein the coating layer comprises poly-p-xylylene (parylene N) and poly-chloro-p-xylylene (parylene C).

12. The ink-jet head of, claim 9, wherein the thickness of the coating layer is from 1 to 10 $\mu$m.

13. An ink-jet head comprising:

(a) a substrate forming an ink channel having an electrode provided on an inner surface of the ink channel; and (b) a coating layer covering the electrode, wherein the coating layer comprises poly-p-xylylene admixed with a silane coupling agent or a derivative of poly-p-xylylene admixed with a silane coupling agent; and wherein the coating layer comprises the silane coupling agent in an amount of at least 0.1 mg/cm$^3$ expressed in terms of Si within a 0.1 $\mu$m region from the coating layer-substrate interface.

14. An ink-jet head comprising:

(a) a substrate forming an ink channel having an electrode provided on an inner surface of the ink channel; and (b) a coating layer covering the electrode, wherein the coating layer comprises poly-p-xylylene admixed with a silane coupling agent or a derivative of poly-p-xylylene admixed with a silane coupling agent; and wherein the coating layer comprises the silane coupling agent in an amount of at most 5 mg/cm$^3$ expressed in terms of Si within the 0.1 $\mu$m region from the coating layer-substrate interface.

15. An ink-let head comprising:

(a) a substrate forming an ink channel having an electrode provided on an inner surface of the ink channel; and (b) a coating layer covering the electrode, wherein the coating layer comprises poly-p-xylylene admixed with a silane coupling agent or a derivative of poly-p-xylylene admixed with a silane coupling agent; and wherein the coating layer comprises the silane coupling agent in an amount of from 0 to 0.5 mg/cm$^3$ expressed in terms of Si within a 0.5 $\mu$m region from the outermost surface of the coating layer.

16. An ink-jet head comprising:

(a) a substrate forming an ink channel having an electrode provided on an inner surface of the ink channel; and (b) a coating layer covering the electrode, wherein the coating layer comprises poly-p-xylylene admixed with a silane coupling agent or a derivative of poly-p-xylylene admixed with a silane coupling agent; and wherein the coating layer comprises poly-p-xylylene (parylene N) in an amount of at most 50 mole % based on the moles of compounds in the coating layer.

17. An ink-jet head comprising:

(a) a substrate forming an ink channel having an electrode provided on an inner surface of the ink channel; and (b) a coating layer covering the electrode, wherein the coating layer comprises poly-p-xylylene admixed with a silane coupling agent or a derivative of poly-p-xylylene admixed with a silane coupling agent; and said poly-p-xylylene (parylene N) is contained in an amount of at least 70 mole % based on the moles of compounds in the coating layer within a region of a half of the coating layer thickness from the coating layer-substrate interface; and said poly-chloro-p-xylylene (parylene C) is contained in an amount of at least 70 mole % based on the moles of the compounds in the coating layer within a region of a half of the coating layer thickness from the outermost surface of the coating layer.

* * * * *